US006010658A

United States Patent [19]

Ross et al.

[11] Patent Number: 6,010,658

[45] Date of Patent: Jan. 4, 2000

[54] APPARATUS FOR DESULFURIZATION OF IRON UTILIZING TWO SPACED APART LANCES

[75] Inventors: Michael S. Ross, Spencer; Ronald L. Downard, Elkton, both of Ohio; Larry J. Epps; Joseph R. Waitlevertch, both of Butler, Pa.

[73] Assignee: ESM III, Amherst, N.Y.

[21] Appl. No.: 09/190,663

[22] Filed: Nov. 12, 1998

[51] Int. Cl.[7] ..... C21C 5/30

[52] U.S. Cl. ..... 266/226; 266/225; 266/265

[58] Field of Search ..... 266/225, 265, 266/226

[56] References Cited

U.S. PATENT DOCUMENTS

| | | | |
|---|---|---|---|
| 3,729,183 | 4/1973 | Ando et al. | 266/225 |
| 3,792,849 | 2/1974 | Kosmider et al. | 266/225 |
| 3,824,095 | 7/1974 | Ando | 266/225 |
| 4,426,709 | 1/1984 | Fegrel et al. | 266/225 |
| 5,188,661 | 2/1993 | Cook et al. . | |

*Primary Examiner*—Scott Kastler
*Attorney, Agent, or Firm*—John C. Thompson

[57] ABSTRACT

A desulfurization apparatus which employs first and second separate independently movable spaced apart lances (10, 12), each lance having a single conduit (22) through which the desulfurization materials may flow from feed vessels (40, 42, 44, 46) into the molten iron in a ladle (16). First and second independently operable raising and lowering apparatus (28, 30) are provided, the first raising and lowering apparatus (28) being connected to the first lance (10), and the second raising and lowering apparatus (30) being connected to the second lance. Each of the first and second raising and lowering apparatus (28,30) is capable of moving the associated lance (10, 12) from between a raised position where the lower end of the associated lance is spaced above the surface of the molten iron in the ladle and a lowered position where the lower end of the associated lance is spaced within the ladle at a proper location for desulfurization of the molten iron. The first and second raising and lowering apparatus are spaced apart sufficiently so the reaction zones do not overlap even at maximum flow rate of desulfurization materials.

7 Claims, 5 Drawing Sheets

APPARATUS FOR DESULFURIZATION OF IRON UTILIZING TWO SPACED APART LANCES

TECHNICAL FIELD

The present invention relates to an apparatus for desulfurization of molten iron, and more particularly to an apparatus where two separate spaced apart lances may be used at the same time to decrease the throughput time of a desulfurization station.

BACKGROUND OF THE INVENTION

It is common when making steel to take molten iron from a blast furnace, subject it to desulfurization, introduce it into a basic oxygen furnace to remove carbon, and to then continuously cast the resultant liquid product. As a practical matter, it is desired to complete the desulfurization process without undue delay, in order not to interrupt downstream processing. If there is an interruption in flow of materials and the ribbon of continuous cast material becomes broken, it costs $100,000 or more to restart the ribbon. Therefore, it is essential that the desulfurization of the iron from the blast furnace continue without significant interruption.

In a single lance, single conduit prior art design of the type previously commercialized by ESM II and others, two feed vessels are commonly utilized, one for magnesium reagent powder mixtures (typically powdered in the range of 0.2 to 1.0 millimeters diameter) and one for a pulverized reagent, which may be lime, carbide, or other mixture of products, (typically pulverized to about 75 micron diameter), the pulverized reagent being used to transport the magnesium reagent. (While two vessels are commonly used, in some situations there may be a single vessel, or more than two vessels.) Each of the vessels is pressurized. At the bottom of each of the two vessels is an orifice. The orifice may be a variable valve of the type disclosed in U.S. Pat. No. 5,108,075, or it may be fixed. If fixed, flow rates may be varied by varying the pressure in the vessel, or by changing the orifice. When fixed orifices are employed, it is also necessary to employ a gate valve or the equivalent.

Initially, an inert gas under pressure, which is typically referred to as transport gas, will be introduced into a tube below the orifice in the pulverized reagent vessel to initiate flow of the pulverized reagent. The transport gas will initially flow from a location below the orifice of the pulverized reagent vessel to a location below the orifice of the magnesium reagent vessel, so the pulverized reagent can pick up the magnesium reagent, and transport it to a lance. Once flow has been established, further use of transport gas is minimized in the transport system. Typically, the pulverized reagent and magnesium reagent powder mixture will be mixed in a 3:1 ratio, i.e., 75 lbs. of pulverized reagent per minute to 25 lbs. of magnesium reagent per minute, although other ratios may be employed. This mixed product will be introduced into a ladle which may vary in size to hold approximately 100–300 metric tons of iron. This mixed product is introduced into the bottom of the ladle via a lance into a "reaction zone" where the magnesium reagent reacts with sulfur within the molten iron to drive off the sulfur. The lance includes a monolithic refractory element formed typically about a 3"diameter round or square section structural tube which in turn receives a ½", ¾", or 1" pipe, the magnesium reagent and pulverized reagent flowing through the pipe within the structural tube.

In the single lance, single conduit operation just described, there is a maximum rate at which the magnesium reagent can be introduced into the single reaction zone. This is because magnesium has a high vapor pressure. If introduced too fast there may be undesirable splashing and turbulence resulting in loss of iron, and the efficiency of the reagent is reduced. Therefore, in certain situations, when there is a high initial sulfur content in the molten iron to be processed (for example 0.10% sulfur, with a desired completion percentage of 0.005% sulfur), there may be an undesirable length of time between the start and completion of the desulfurization.

In a prior design, two reaction zones are achieved by providing a lance with a single conduit which terminates at its lower end in a T-fitting. While the reagent will be discharged into two separate reaction zones, to either side of the lance, problems have been encountered. Thus, one of the T's in this type of lance is more likely to become plugged than a single conduit, single discharge lance. When one of the T's becomes plugged, there is only a single desulfurization zones to the side of the lance.

In order to overcome the problems of the single lance, single conduit design, it has been proposed in U.S. Pat. No. 5,188,661 to use a single lance provided with two conduits for the introduction of the desulfurization material. In this single lance, dual conduit design, as can be seen from the drawings of U.S. Pat. No. 5,188,661, each of two steel conduits 16 are disposed within a ceramic body 28 and terminates at a port 24, there being an angled extension formed by an elbow fitting 30. While this single lance dual conduit design provides two reaction zones, permitting the magnesium reagent to be introduced at a faster rate than with a single lance, it shares a problem with the single lance, single conduit design. Thus, in the event a conduit becomes plugged, the lance must be retracted from the molten iron in the ladle, stopping the desulfurization until a new lance can be introduced. While plugging occurs less often than in the T-fitting design, as the pressure in each line tends to keep the discharge port from plugging, plugging still happens. In addition, as the two reaction zones are closely spaced together, there may not be sufficient agitation of all of the iron within the ladle, causing some of the iron not to be fully desulfurized.

OBJECTS AND SUMMARY OF THE INVENTION

It is an object of the present invention to provide an apparatus capable of desulfurizing molten iron without significant interruption.

More particularly, it is an object of the present invention to provide a desulfurization apparatus which employs first and second separate independently movable spaced apart lances, each lance having a single conduit through which the desulfurization materials may flow from the feed vessels into the molten iron in a ladle. First and second independently operable raising and lowering means are provided, the first raising and lowering means being connected to the first lance, and the second raising and lowering means being connected to the second lance. Each of the first and second raising and lowering means is capable of moving the associated lance from between a raised position where the lower end of the associated lance is spaced above the surface of the molten iron in the ladle and a lowered position where the lower end of the associated lance is spaced within the ladle at a proper location for desulfurization of the molten iron. The first and second raising and lowering means are spaced apart sufficiently so the reaction zones do not overlap even at maximum flow rate of desulfurization materials.

It is a further object of the present invention to provide a desulfurization apparatus of the type set forth above wherein first and second feed vessels are provided. The first feed vessel is normally interconnected with the first lance, and the second feed vessel is normally interconnected with the second lance. In addition, crossover means are provided to permit the first vessel to be interconnected with the second lance and the second vessel to be interconnected with the first lance.

The foregoing objects of this invention, as well as other objects and advantages of this invention, will be more fully appreciated after a consideration of the following detailed description taken in conjunctions with the accompanying drawings in which a preferred form of this invention is illustrated.

DETAILED DESCRIPTION

Figure 1:
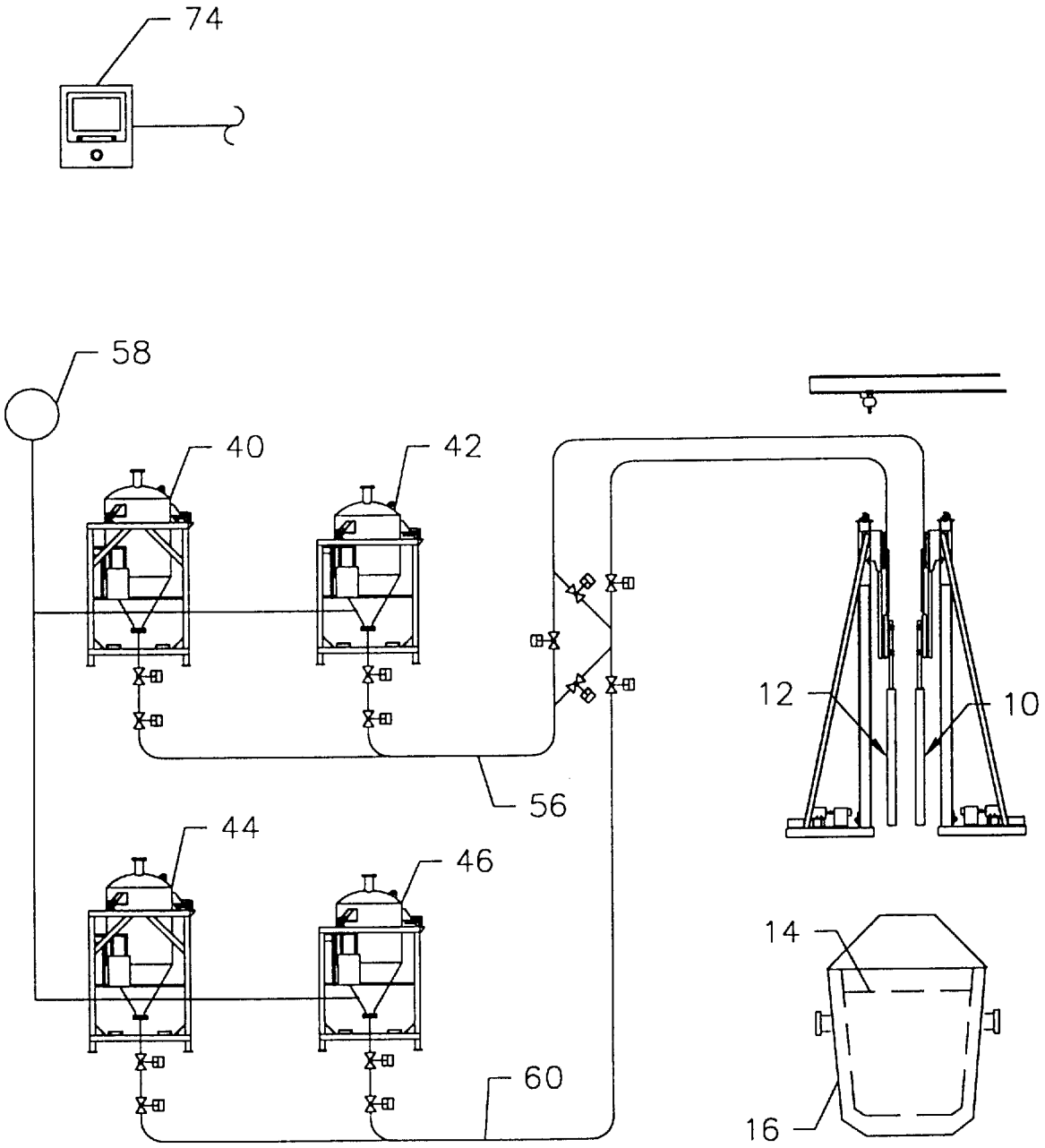
FIG. 1 is a schematic view of the apparatus of this invention.
Figure 2:
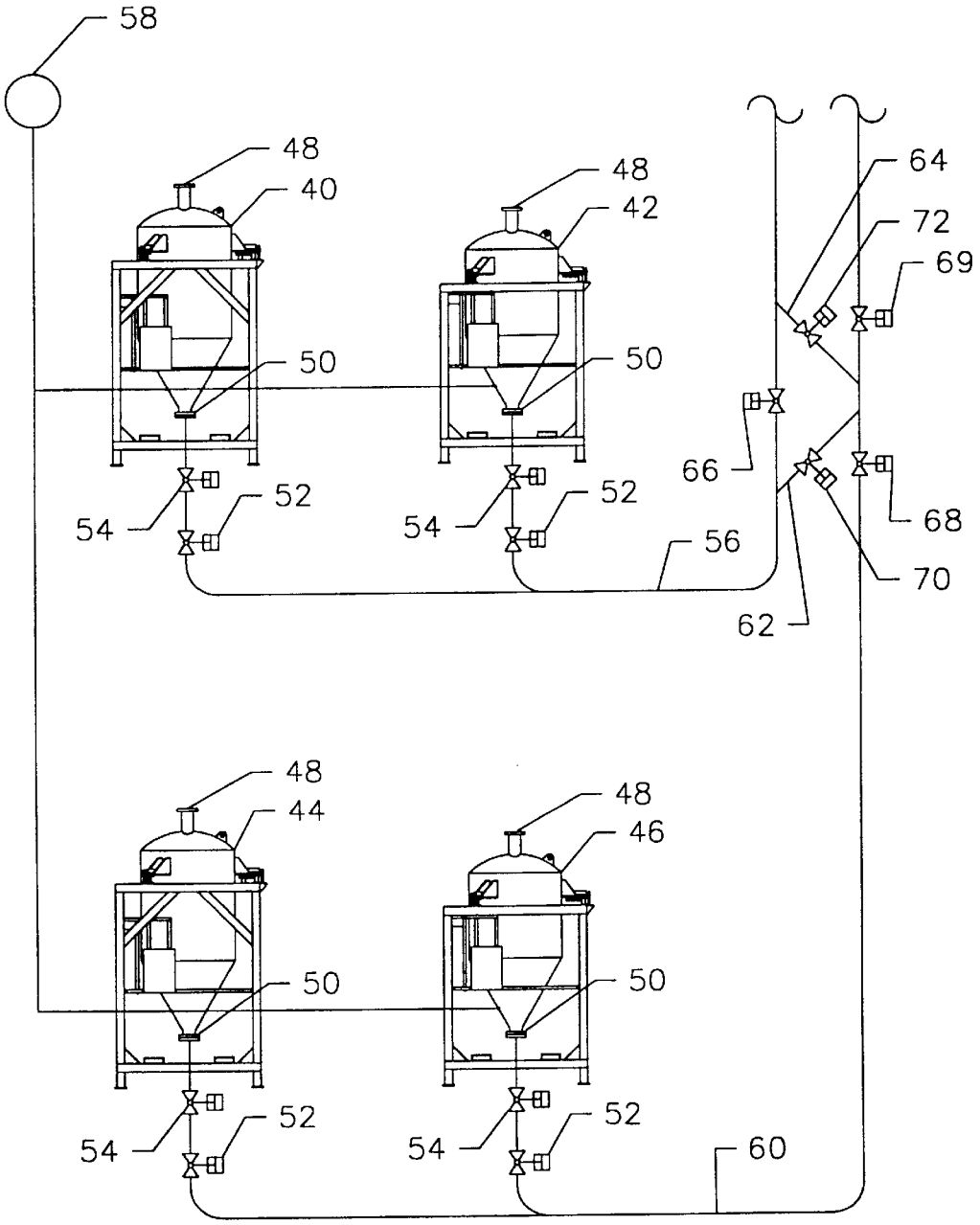
FIGS. 2 and 3 are enlarged views of portions of the apparatus shown in FIG. 1.
Figure 3:
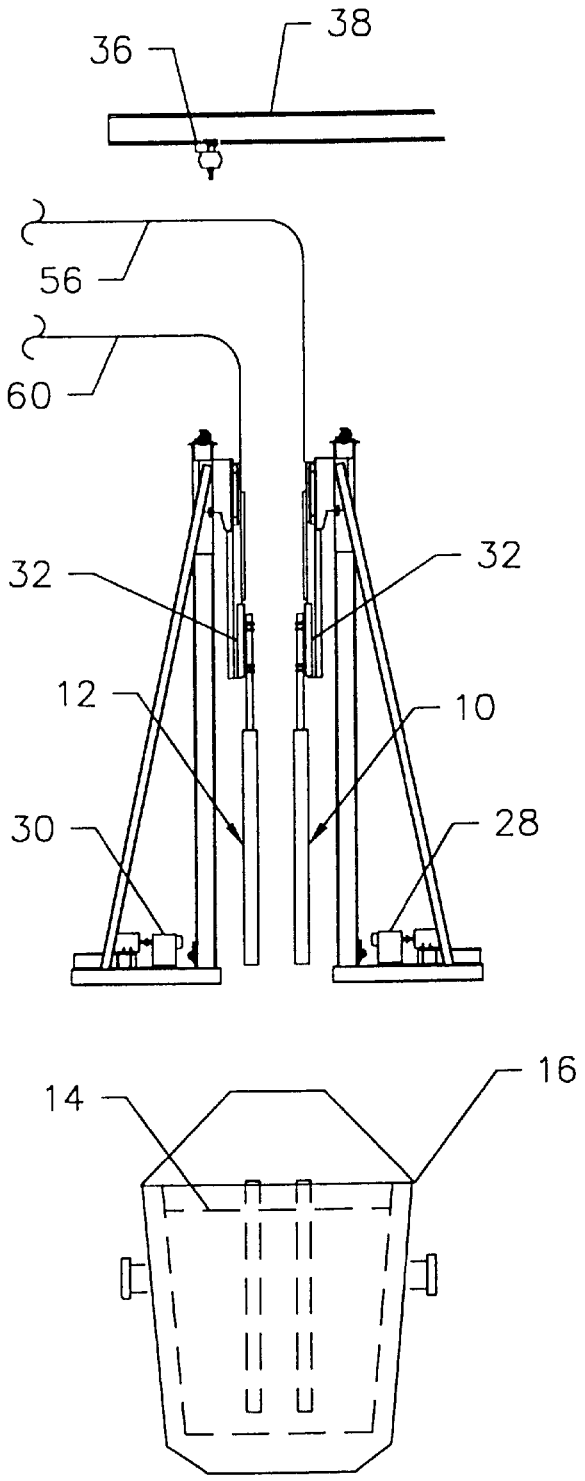
Figure 4:
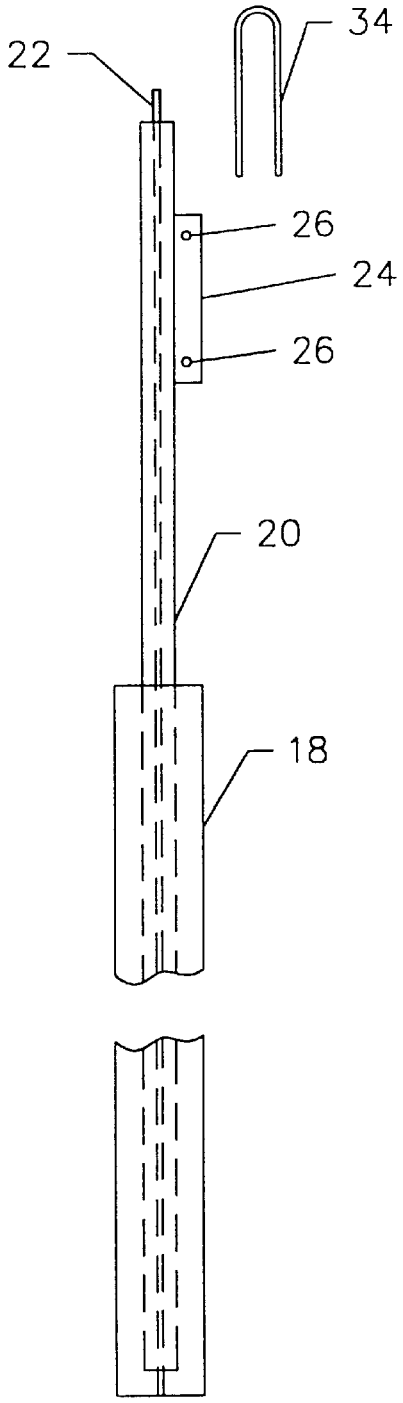
FIG. 4 is a side elevational view of a lance which may be used in the present apparatus.
Figure 5:
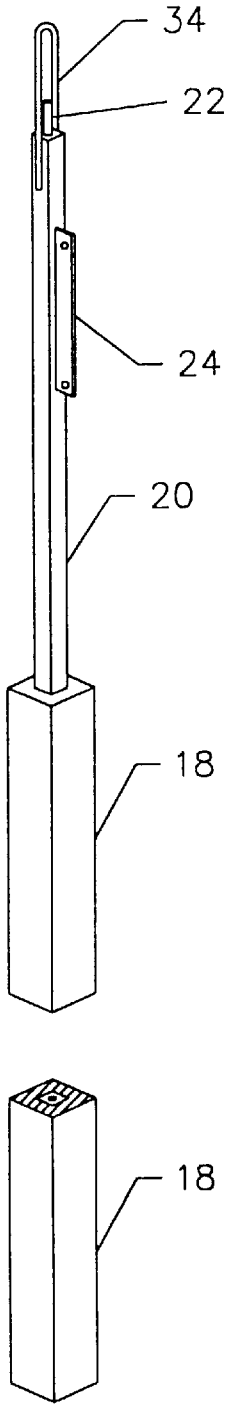
FIG. 5 is an isometric view of the lance shown in FIG. 4.

With reference initially to FIG. 1, separate first and second lances, indicated generally at 10 and 12, respectively, are provided for the desulfurization of molten iron 14 contained within a ladle 16 or the like. In the embodiment shown in the drawings, the ladle is approximately 10 ft. in diameter and 12 ft. deep, which ladle can hold approximately 200 metric tons of molten iron. However the present invention may be used with other ladle sizes. Each of the first and second lances is substantially identical and consists of a monolithic refractory element 18 (FIG. 5) which may initially be 12.5 ft. long from top to bottom and may be 8 inches in diameter. The monolithic refractory element is formed about a 3"diameter structural tube 20, which may be square or round in cross section, the structural tube extending through all but the last 3 in. of the monolithic refractory element 18, and extending above the monolithic refractory element by about 10 ft. A conduit in the form of a ½", ¾", or 1" i.d. pipe 22 extends throughout the length of the monolithic refractory element 18 and structural tube 20 and projects above the tube 20 a distance sufficient to connect it to a reagent line. The structural tube 20 is secured to a lance raising and lowering mechanism. To this end a steel plate 24 is secured to the tube by welding or the like. The steel plate 24 is in turn provided with apertures 26 through which suitable fasteners, such as bolts, may be passed to secure the structural tube to the raising and lowering means.

In accordance with this invention, the first lance 10 is connected to a first raising and lowering means 28 and the second lance is connected to a second raising and lowering means 30. Each of the first and second raising and lowering means is of essentially the same construction and as illustrated includes a motor gearbox with a chain drive arrangement. Alternatively, it may include a hydraulic cylinder assembly. In either case, the raising and lowering means moves vertically, and will move a lance drive head 32 in the form of a receiving clamp or plate 32 vertically, the plate 24 being secured to the lance drive head 32. The lance drive head 32 will be moved upwardly and downwardly by the raising and lowering means in such a manner that the lower end of the associated lance is spaced above the molten iron within the ladle when in the fully raised position, and the lower end of the associated lance is spaced within the ladle at a proper location for desulfurization of the molten iron when in the lowered position. Typically, this position may be about 18 in. above the bottom of the ladle.

It should be appreciated that during the desulfurization of molten iron it will occasionally be necessary to replace one lance with another. In order to facilitate the replacement of a lance, each lance is provided with an inverted U-shaped structure or loop 34 (FIG. 5) which is welded or otherwise suitably secured to the upper end of the structural tube 20, the inverted U-shaped structure extending above the pipe 22 a distance sufficient so that it may receive a hook (not shown) carried by a cable hoist 36 on jib crane 38. To replace a lance it is first raised to a position above the molten iron, the hook is placed in the loop 34, the plate 24 is disconnected from the lance drive head 32, and then the cable hoist 36 and jib crane 38 are suitably operated in a manner well known to those skilled in the art. By utilizing two separate lances, each with its own conduit, suitable servicing of removed lances may be accomplished.

For example, if one of the lances becomes plugged to such an extent that it is no longer operable, it may be removed and replaced with a new (or repaired) lance. Thus, by using two separately mounted lances, each with its own conduit, service of the lances can be performed permitting continuous operation of the desulfurization process. (The lances of the present design may be repaired. Thus, if the lance becomes plugged, the top of the pipe 22 is built up by adding a coupling and another length of pipe, the pipe is then driven down through the refractory element 18 until the plugged portion of the pipe extends below the refractory element 18, and the plugged portion is then cut off.)

As is conventional, each of the first and second lances is connected to suitable feed vessels. Thus, the first lance 10 is typically connected to first pressurized feed vessels 40 and 42, and the second lance 12 is typically connected to second pressurized feed vessels 44 and 46. For the purposes of this disclosure, each of the vessels will be considered to be the same. Thus, each vessel is provided with an inlet 48 for receiving suitable materials, and an outlet 50 through which the suitable materials are discharged. A variable orifice valve 52 for controlling material flow rates and a cut-off valve 54 are mounted in a discharge line below the outlet 50 of each vessel. The first feed vessel 40 and second feed vessel 44 receive a pulverized reagent mixture and the first feed vessel 42 and second feed vessel 46 receive magnesium reagent powder mixture. It can be seen that the magnesium reagent powder mixture and the pulverized reagent mixture will flow from the first vessels 40, 42 into first line means 56. Flow through the line 56 will be facilitated by the introduction of an inert transport gas from a source of transport gas under pressure 58 in a manner well known to those skilled in the art. Flow from each of the vessels to the line 56 is controlled via the variable orifice valves 52 when the shut-off valve 54 is open. Similarly, the magnesium reagent powder mixture and the pulverized reagent will flow from the first vessels 44, 46 into second line means 60 in a similar manner, the rate of flow also being controlled by a variable orifice valve. As can be seen from FIG. 1, line 56 is connected with the first lance 10 and line 60 is connected with the second lance 12.

It is a feature of this invention that the first and second line means 56 and 60 can be alternatively connected with the first and second lances 10 and 12 via the employment of suitable crossover means. Thus, it may happen that the first lance has been removed from service and one of the vessels for the second lance is either out of materials, or is not functioning in a proper manner. In order to maintain operations, it is desirable that second lance may continue to discharge desulfurization materials into the molten iron. This may be accomplished by providing a cross-over network which, according to this invention consisted of third line means 62 extending from the first line mans 56 to the second line means 60, and fourth line means 64 extending from the second line means 60 to the first line means 56. In order to properly control the flow during a cross-over operation, each of the line means 56, 60, 62, 64 is provided with a suitable shut-off or gate valves 66, 68, 69, 70, 72, gate valve 66 being in the first line means 56, gate valves 68 and 69 being in the second line means 60, gate valve 70 being in the third line means 62, and gate valve 72 being in the fourth line means 64. During normal operation, when both lances are being used, gate valves 66, 68 and 69 will be open and gate valves 70 and 72 will be closed. If only lance 10 is being used, with supply from vessels 40 and 42, only gate valve 66 will be open, the other gate valves 68 –72 being closed. Alternatively, if lance 10 is being used with supply from vessels 44 and 46, gate valve 68 and 72 will be open, with the remaining gate valves being closed.

It can be seen from the above description that many of the prior art problems have been overcome by the present design. Thus, the two separate lances may be suitable spaced apart so that the reaction zones are also suitably spaced apart within the molten iron, permitting increased flow rates and material efficiency over that when two conduits are placed in a single lance.

Suitable control means are provided for the proper operation of the present apparatus. Thus, a single operator may control the process of desulfurization materials to the lances via a control screen 74 (FIG. 1) which is suitably interconnected with the various control components set forth above, along with additional conventional measuring devices (not illustrated) which are used to determine material weight and flow rates. As the operator will know the initial sulfur content of the molten iron as well as the desired sulfur content of the molten iron after desulfurization, he can determine whether one or two lances should be used, and he can also determine the flow rate or rates through the lances to achieve the desired end product. In addition, the operator can vary the flow rates as desired to efficiently achieve the flow of plant production.

While a preferred form of this invention has been described above and shown in the accompanying drawings, it should be understood that applicant does not intend to be limited to the particular details described above and illustrated in the accompanying drawings. Thus, it is the desire of the inventors of the present invention that it be clearly understood that the embodiments of the invention, while preferred, can be readily changed and altered by one skilled in the art and that these embodiments are not to be limiting or constraining on the form or benefits of the invention.

What is claimed is:

1. Desulfurization apparatus for treating molten iron comprising:

a ladle which receives the molten iron to be treated;

feed vessels for the materials to be introduced into the molten iron for desulfurization, the materials including a magnesium reagent powder mixture;

first and second lances, each lance having a single conduit through which the desulfurization materials may flow from the feed vessels into the molten iron in the ladle, the desulfurization materials creating a reaction zone when introduced into the molten iron; and first and second independently operable raising and lowering means capable of moving the first and second lances into and out of the ladle, the first raising and lowering means being connected to the first lance, and the second raising and lowering means being connected to the second lance, each of the first and second raising and lowering being capable of moving the associated lance from between a raised position where the lower end of the associated lance is spaced above the surface of the molten iron in the ladle and a lowered position where the lower end of the associated lance is spaced within the ladle at a proper location for desulfurization of the molten iron, the first and second raising and lowering means being spaced apart sufficiently so the reaction zones do not overlap even at maximum flow rate of desulfurization materials.

2. The desulfurization apparatus as set forth in claim 1 wherein the raising means is a hydraulic cylinder assembly.

3. The desulfurization apparatus as set forth in claim 1 wherein the raising and lowering means is a motor gearbox with chain drive arrangement.

4. The desulfurization apparatus as set forth in claim 1 wherein there are first and second feed vessels for the magnesium reagent mixture, the first feed vessel being normally interconnected with the first lance through first line means, and the second feed vessel being normally interconnected with the second lance through second line means.

5. The desulfurization apparatus as set forth in claim 4 wherein control means are provided for independently controlling the flow rates from the first and second vessels.

6. The desulfurization apparatus as set forth in claim 4 wherein each of the first and second feed vessels is a pressurized feed vessel for magnesium reagent powder mixtures.

7. The desulfurization apparatus as set forth in claim 4 wherein third and fourth line means are provided which extend between the first and second lines, each of the first, second, third and fourth lines being provided with shutoff valve means and wherein further control means are provided for operating the valve means in such a manner that the output from the first feed vessels can be sent to the second lance or alternatively the output from the second feed vessels can be sent to the first lance.

* * * * *